US008371081B2

(12) United States Patent
Bennett et al.

(10) Patent No.: US 8,371,081 B2
(45) Date of Patent: Feb. 12, 2013

(54) CORNER GUARD

(75) Inventors: Matthew Bennett, New Berlin, WI (US); Roger Lehrkamp, Milwaukee, WI (US)

(73) Assignee: Inpro Corporation, Muskego, WI (US)

( * ) Notice: Subject to any disclaimer, the term of this patent is extended or adjusted under 35 U.S.C. 154(b) by 308 days.

(21) Appl. No.: 12/826,011

(22) Filed: Jun. 29, 2010

(65) Prior Publication Data

US 2011/0315298 A1 Dec. 29, 2011

(51) Int. Cl.
*E04B 2/00* (2006.01)

(52) U.S. Cl. ..... 52/287.1; 52/288.1; 52/255

(58) Field of Classification Search ..... 52/287.1, 52/288.1, 255

See application file for complete search history.

(56) References Cited

U.S. PATENT DOCUMENTS

| | | | | |
|---|---|---|---|---|
| 5,313,754 | A * | 5/1994 | Jensen | 52/255 |
| 5,526,559 | A * | 6/1996 | Fleenor et al. | 29/434 |
| 5,916,101 | A * | 6/1999 | Stibolt | 52/254 |
| 6,427,401 | B2 * | 8/2002 | Bennett | 52/288.1 |

OTHER PUBLICATIONS

Koffler sales Company Corner Guard with Aluminum Retainer #A67, Jan. 2010 archived webpage.*

* cited by examiner

*Primary Examiner* — Jeanette E Chapman
*Assistant Examiner* — Daniel Kenny
(74) *Attorney, Agent, or Firm* — Boyle Fredrickson, S.C.

(57) ABSTRACT

A wall guard for use around wall corners is disclosed in which the wall guard includes a pair of retainers are flexibly mounted to one another. The retainers are coupled to one another by way of an adhesive tape material that extends over the back sides of the retainers. A cover is secured to the pair of retainers for absorbing impacts from passing traffic to thereby protect the corner of the wall against wear and tear.

21 Claims, 4 Drawing Sheets

CORNER GUARD

FIELD OF THE INVENTION

This invention relates to door and wall protection structures, and, more particularly, to a corner guard for accommodating a number of different corner configurations.

BACKGROUND OF THE INVENTION

It is often desirable to provide wall and door mounted structures for protecting the door and wall from general wear and tear often associated with high traffic areas. For instance, such structures are commonly used in school, hospital, nursing home, and other such settings where there is a large amount of pedestrian traffic such that the walls and doors experience a relatively high amount of wear and tear as compared to less trafficked areas. Further, such locations commonly involve the movement of relatively large equipment in and out of hallways and doors such that the doors and walls experience further wear and tear in connection with the movement of such equipment. For example, in hospitals, patient beds, gurneys, wheel chairs, mobile imaging equipment and the like are often moved from one place to another and in doing so often unintentionally impacts the walls and doors by which they travel. Accordingly, these locations often employ wall and door guards and other such protection structures to guard against the wear and tear often associated with these uses.

One such type of wall guard is a corner guard. Corner guards are employed around the corners of walls to absorb the impact from traffic around the corners. Corners are particularly susceptible to damage from traffic traveling therearound because it is often difficult to navigate corners with large equipment and the like. Accordingly, it is increasingly common for facilities to employ the use of corner guards around corners in high traffic errors to protect the corners of the walls as well as those areas immediately adjacent. One disadvantage of known corner guards is that they are not readily adjustable to accommodate a number of different corner configurations. Thus, makers of such corner guards often have to custom make corner guards to accommodate the particular needs of the facility in which the guards are to be installed. This increases the cost associated with the production and installation of the costs and requires. The process of custom making the corner guards can take several weeks to complete and thus it is impractical to simply produce the corner guards on an as-needed basis. Thus, the makers of the corner guards must store a large number of differently configured corner guards to accommodate the needs of various customers.

It is therefore desired to provide a corner guard that does not suffer from the foregoing disadvantages. It is further desired to provide a corner guard that is relatively durable and inexpensive to manufacture.

SUMMARY OF THE INVENTION

According to one aspect of the invention, a two-piece corner guard is provided. The corner guard of the invention includes a pair of retainer wings coupled to one another by way of a durable tape or other such adhesive or fastener. The tape is provided on the back of each of the retainer wings and is relatively flexible such that the wings may be folded out to accommodate a plurality of different corner angles. A cover is configured to receive the retainers in channels defined along edges thereof to provide a relatively impact absorbent surface about the corner of the wall. In this way, the corner and surrounding wall portions are protected from impacts caused by traffic travelling around the corner.

The retainer wings preferably include a distally formed flange portion configured to cooperate with the edges of the cover and to be received in the channel thereof. In this manner, the retainer wings are selectively slidably insertable into the cover.

The retainer wings are preferably constructed from a relatively durable material adapted for coupling to a wall surface such as aluminum or another such similar material. The cover is preferably constructed from an impact resistance material such as a plastic or the like. In an embodiment of the invention, the plastic material is vinyl.

The retainer wings are preferably adjustable with respect to one another by bending the retainer wings with respect to one another. In this manner, the retainer wings are capable of selective adjustment between approximately 67 and 158 degrees. Accordingly, in construction of the corner guard of the invention, only one size retainer wing need be made to accommodate corners having a variety of configurations. Instead, after construction thereof, the retainer wings are simply bent to accommodate the desired corner angle thereby saving on manufacturing costs and providing a highly configurable corner guard capable of use in a wide number of locations.

Numerous other aspects, features and advantages of the invention will be made apparent from the following detailed description.

DETAILED DESCRIPTION OF THE INVENTION

Figure 1:
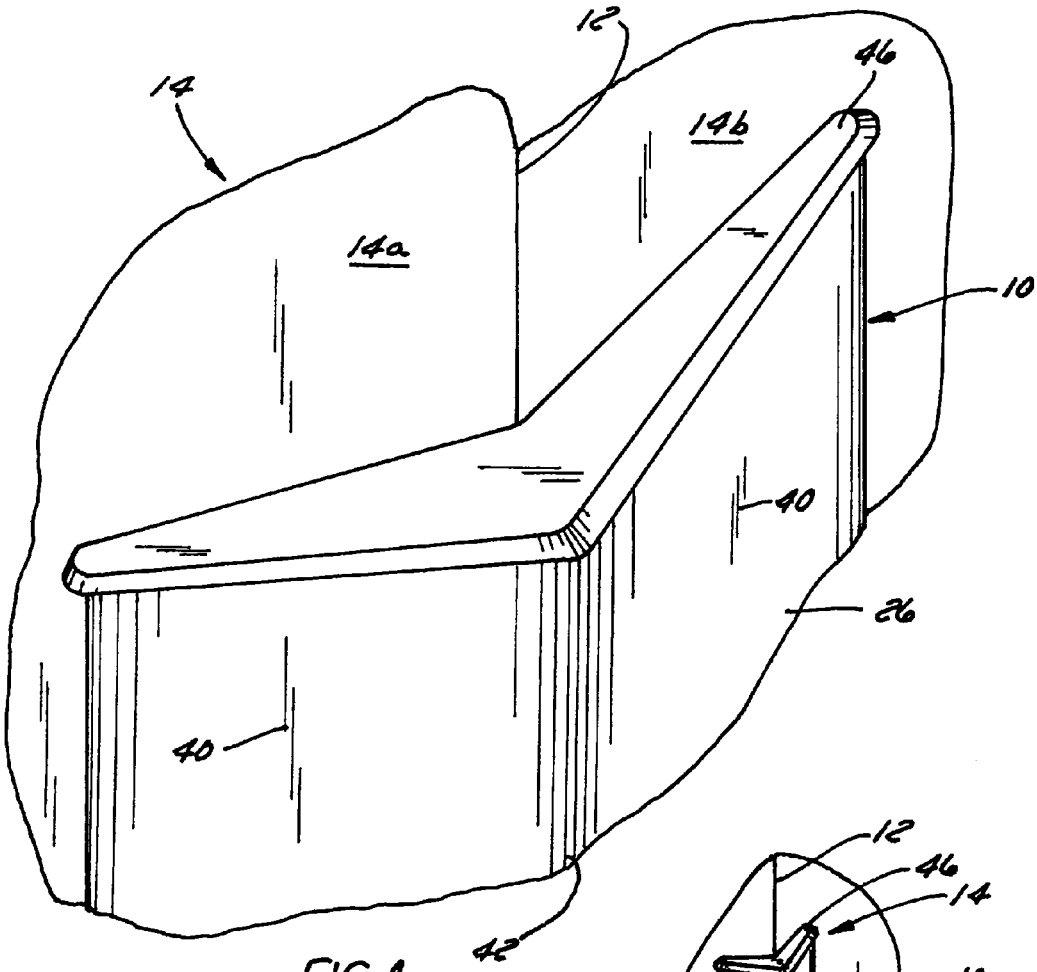
FIG. 1 is a partial isometric view of a corner guard of the invention attached to a corner of a wall.
Figure 2:
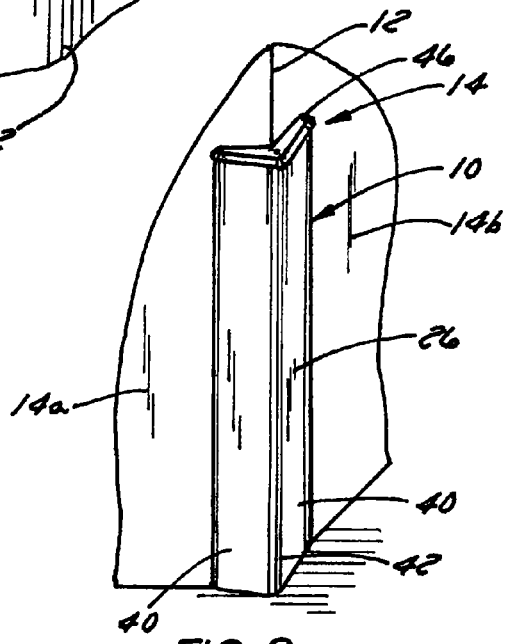
FIG. 2 is an isometric view of the corner guard of FIG. 1.
Figure 3:
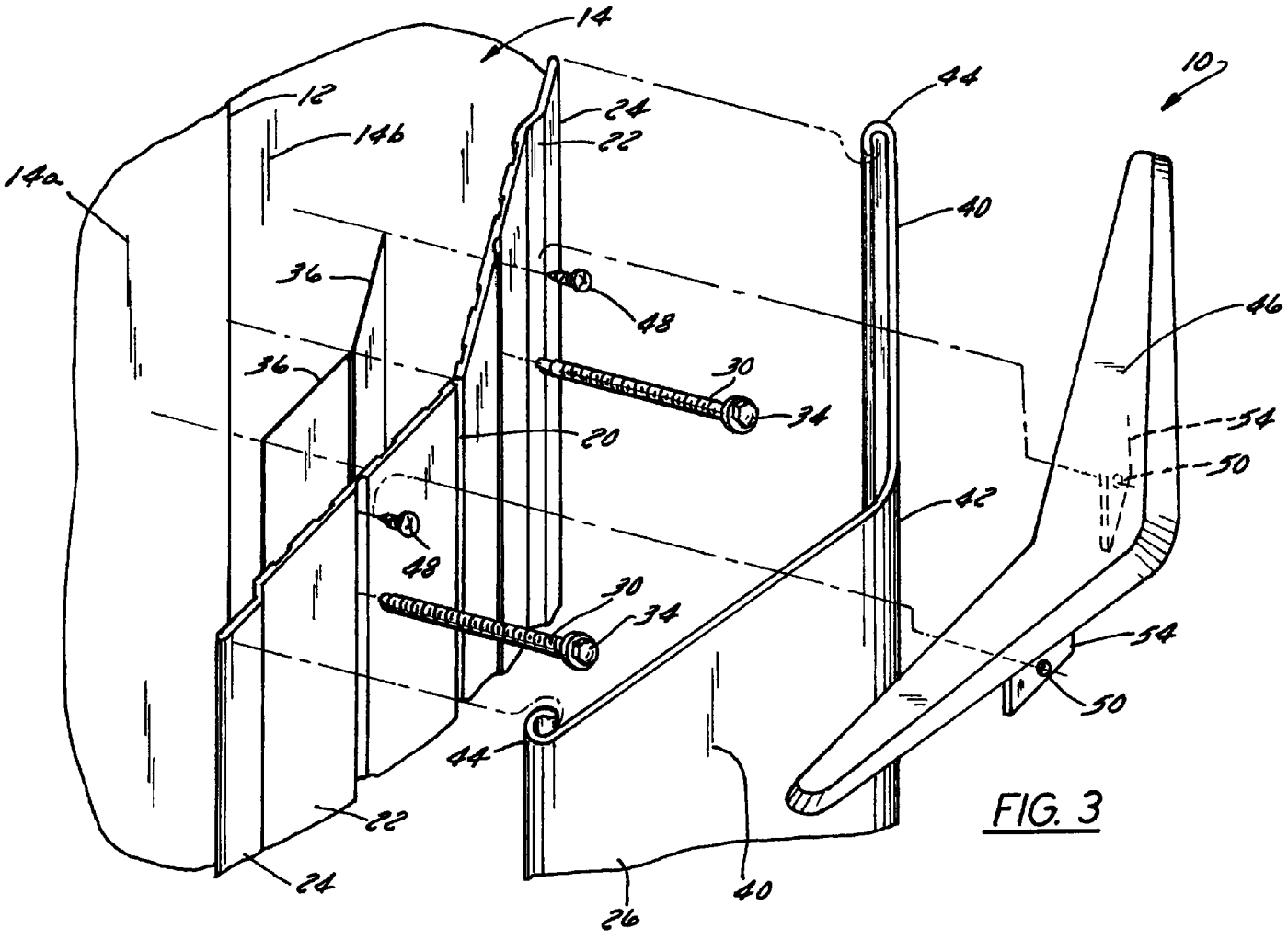
FIG. 3 is a partial exploded view of the corner guard of FIG. 1.
Figure 4:
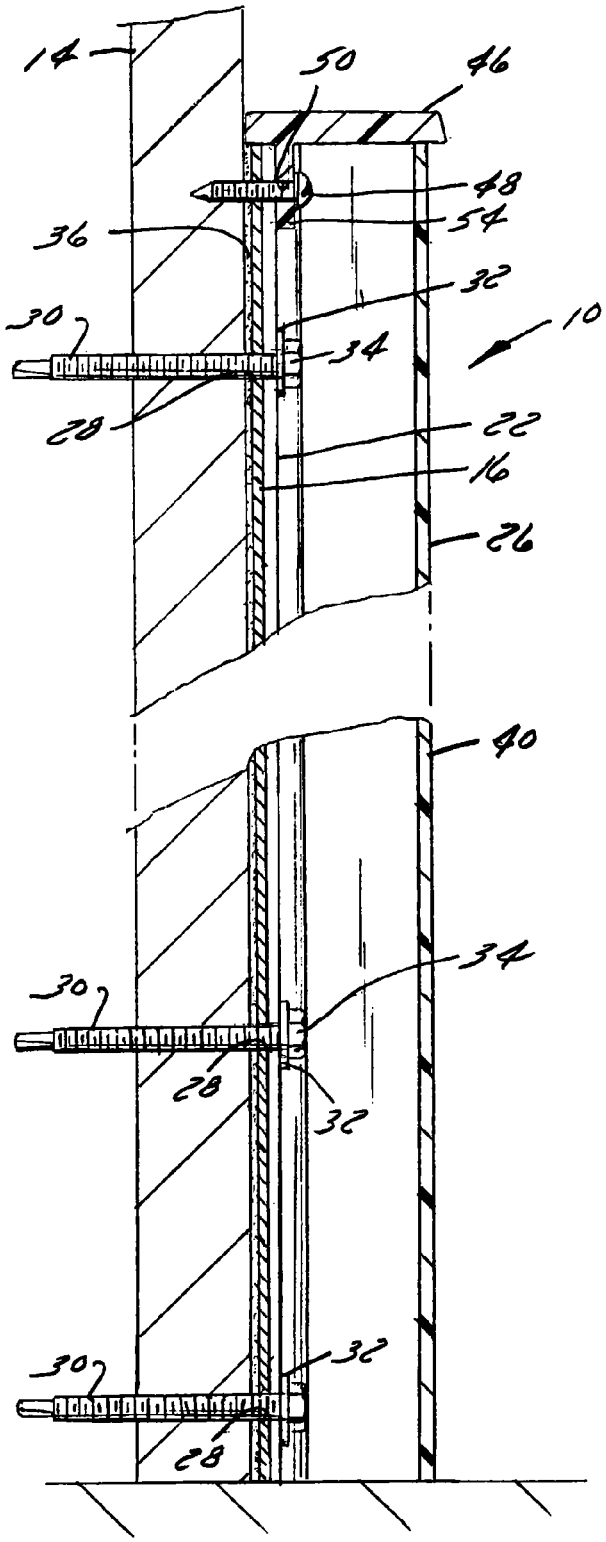
FIG. 4 is a cross section view of the corner of the wall with the corner guard of FIG. 1 mounted thereto.
Figure 5:
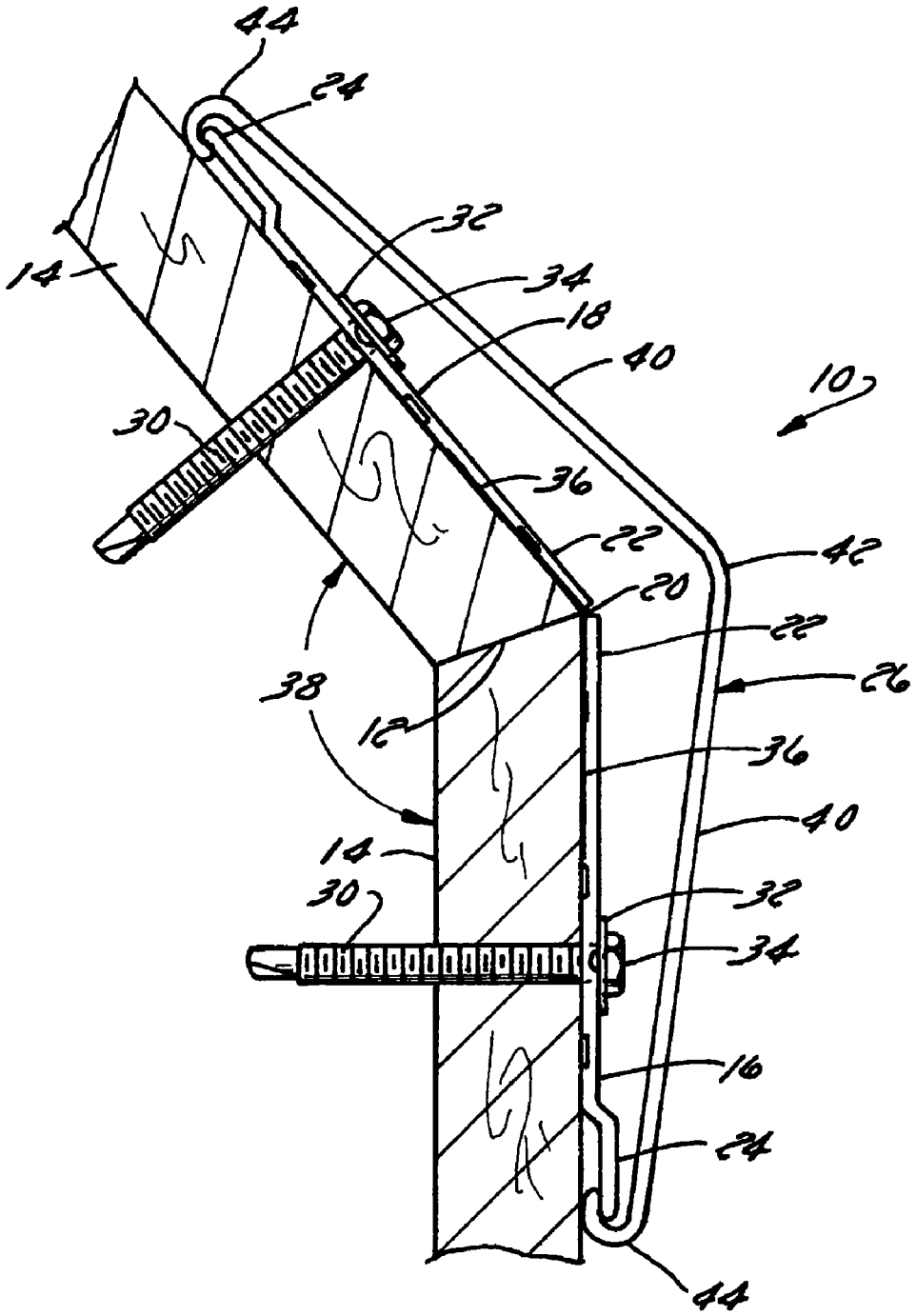
FIG. 5 is a cross section view of the corner guard of FIG. 1 mounted to the corner of the wall.

Referring now to the Drawings, FIGS. 1-5, a corner guard 10 according to the present invention is illustrated. The corner guard 10 is mounted around a corner 12 of a wall 14. Corner guard 10 comprises a first retainer wing 16 and a second retainer wing 18 adjustably coupled to one another. The retainer wings 16 and 18 are preferably constructed from a relatively durable but pliable material such as aluminum. Other materials having similar characteristics may be used in practicing the invention as is readily understood. Wings 16 and 18 comprise identical shapes and the description of one of wings 16 and 18 is equally applicable to the other of the wings 16 and 18. Wings 16 and 18 include a proximal end 20 and a distal end 22 in which the proximal end 20 is to be positioned at or near the corner 12, and the distal end 22 is to be positioned opposite the corner 12 along one of the adjacent surfaces 14*a*, 14*b* of wall 14. Distal ends 22 of wings 16 and 18 include a flange 24 integrally formed with wings 16 and 18 and extending horizontally away from the wall 14 to define an area of attachment for a cover 26 as will be described in detail. The remainder of wings 16 and 18 is generally planar and abuts directly against wall 14 to define a flush point of attachment about corner 12. Wings 16 and 18 further include one or more apertures 28 through the planar surfaces of wings 16 and 18. Apertures 28 are configured for receiving a fastener 30 such as a self-tapping screw or other similar such fastener 30. Fasteners 30 are inserted through apertures 28 and into wall 14 for securing the wings 16 and 18 in place. A washer 32 or other spacing member may be provided between the head 34 of fastener 30 and wall 14 for preventing the head 34 of fastener 30 from directly abutting wall 14 so as to distribute the load applied to the corner guard 10 and to prevent the head from embedding into the wall 14 or pulling through the wall 14 as is readily understood.

Wings 16 and 18 are coupled to one another by way of an adhesive 36 applied to each of the back surfaces of the wings 16 and 18. Adhesive 36 is a relatively thin layer of tape adapted to flexible couple wings 16 and 18 to one another. Adhesive 36 may comprise MP-20 pressure sensitive adhesive or a similar such adhesive. Preferably, the adhesive 36 is MACTAC Tape, and in particular, BP2003 MACTAC Tape as is generally known in the art. Adhesive 36 extends from one of wings 16 and 18 to the other of wings 16 and 18 and adheres to the adhesive 36 disposed on the other of the wings 16 and 18. In this manner, wings 16 and 18 are flexibly coupled to one another 100 such that they may be folded to accommodate a plurality of different angles. Preferably, the wings 16 and 18 are capable of being folded with respect to one another to accommodate wall angles of between 67.5 degrees and 157.5 degrees as demonstrated by arrow 38. Accordingly, corner guard 10 of the invention is able to accommodate a large number of different corner configurations with little adjustment thereto. In this manner, the cost of production and installation are substantially 105 decreased as compared to prior designs in which the corner guards are custom formed to accommodate a given corner angle.

Cover 26 is constructed from vinyl or a similar such material that is substantially durable and is capable of withstanding a significant amount of impact from traffic passing around corner 12. Corner 26 comprises a unitary structure that is includes a pair of elongate segments 40 and a central segment 42 positioned between the two elongate segments 40. Central segment 42 is rounded so as to conform to the corner 12 of wall 14 as is readily understood. Each of segments 40 includes a hooked end 44 for coupling to flange 24 of wings 16 and 18. In this manner, cover 26 is easily secured to wings 16 and 18 for the purpose of creating a substantially durable corner guard 10 according to the invention.

A top member 46 is coupled to an upper edge of the retainer wings 16, 18 by way of a pair of screws 48. Top member 46 includes a pair of corresponding holes 50 through which the screws 48 are received to thereby couple the top member 46 to a pair of corresponding retainer holes 52. Top member cooperates with cover 26 to overhand cover 26 by a predetermined amount to thereby provide a flush appearance between the corner guard 10 and wall 14. In this manner, the internal structure of corner guard 10 is not visible from the outside thereof, thereby providing an aesthetically pleasing structure while preventing the internal structure from being tampered with or otherwise affected. Top member 46 may include a pair of downwardly extending tabs 54, which carry holes 50 thereon to facilitate coupling of the top member 46 to the retainers 16, 18. Tabs 54 are sized and shaped to be received between the front sides of the retainers 16, 18 and the back side 125 of cover 26 such that the retainers 16, 18 are slidingly received within the hooks 44 of the covers as is readily understood.

Various alternatives are contemplated as being within the scope of the following claims particularly pointing out and distinctly claiming the subject matter regarded as the invention.

We claim:

1. A corner guard comprising:

a wall mounting assembly secured around a corner of a wall, wherein the wall mounting assembly comprises a first retainer wing and a second retainer wing flexibly coupled to one another by a hinge formed of a dissimilar material than the retainer wings and a cover to define a mounting angle, wherein the retainer wings include one or more apertures through the planar surfaces of the retainer wings for receiving a fastener;

the cover secured to the wall mounting assembly configured to withstand impacts from traffic traveling past the corner of the wall, wherein the cover has hooked distal ends configured to slidingly receive the distal ends of the retainer wings to thereby couple the cover to the wall mounting assembly; and a top member coupled to an upper edge of the retainer wings, wherein the top member comprises a first downwardly extending tab and a second downwardly extending tab to facilitate coupling of the top member to the retainer wings, wherein the first and second tab have holes thereon to receive screws that protrude through the top member and through corresponding holes in the retainer wings, and wherein the top member overhangs the cover to provide a flush appearance.

2. The corner guard assembly of claim 1, wherein the first retainer and the second retainer are coupled to one another by an adhesive.

3. The corner guard assembly of claim 2, wherein the adhesive is tape.

4. The corner guard assembly of claim 3, wherein the tape is adhered to rear sides of the first retainer and the second retainer.

5. The corner guard assembly of claim 1, wherein the first retainer and second retainer comprise flanges at distal ends thereof, and wherein the cover is configured to interconnect with the flanges.

6. The corner guard assembly of claim 5, wherein the cover includes hooked portions at distal ends thereof for interconnection with the flanges of the first retainer and the second retainer.

7. The corner guard of claim 1, wherein the cover is constructed from a plastic.

8. The corner guard of claim 7, wherein the plastic is vinyl.

9. The corner guard of claim 1, wherein the retainer wings are coupled to one another such that they may be positioned between 67.5 and 157.5 degrees with respect to the corner of the wall.

10. The corner guard of claim 1, wherein the retainer wings comprise a proximal end positioned at the corner of the wall and a distal end positioned along the wall at a distance from the corner, and wherein a flange is disposed on the distal ends of the retainer wings, and wherein the retainer wings are coupled to the cover at the flanges thereof.

11. The corner guard of claim 10, wherein the cover comprises a pair of elongate portions and a central portion positioned between the elongate portions, and wherein each of the elongate portions includes a longitudinally extending channel defined by a hook portion formed at an edge of the elongate portions, and wherein the flanges of the retainer wings are configured to be slidingly received within the channels defined by the hook portions.

12. A method of making a wall corner guard, the method comprising the steps of:

forming a corner guard support assembly having a first retainer and a second retainer flexibly coupled to one another, by a hinge formed of a material dissimilar to the retainers and a cover that is secured to each of the first retainer and the second retainer wherein the retainers include one or more apertures through the planar surfaces of the retainers for receiving a fastener;

securing the first retainer and second retainer to one another by way of an adhesive applied to back portions of the first retainer and the second retainer;

mounting the corner guard support assembly to a wall such that the first retainer is coupled to one of a pair of adjacent walls and the second retainer is coupled to the other of a pair of adjacent wall;

attaching the cover to a distal end of the first retainer and a distal end of the second retainer;

wherein the first retainer and second retainer are selectively adjustable to one another such that they can conform to a plurality of differently angled wall corners;

attaching a top member to an upper edge of the retainers;

wherein the top member comprises a first downwardly extending tab and a second downwardly extending tab to facilitate coupling of the top member to the retainers;

wherein the first and second tab have holes thereon to receive screws that protrude through the top member and through corresponding holes in the retainers; and wherein the top member overhangs the cover to provide a flush appearance.

13. The method of claim 12, wherein the first retainer and the second retainer are selectively adjustable between 57.5 degrees and 167.5 degrees with respect to the corner of the wall.

14. The method of claim 12, further comprising the step of sliding the first retainer and the second retainer into engagement with the cover by way of a pair of distally disposed channels provided at edges of the cover.

15. The method of claim 12, wherein the first retainer and the second retainer comprise distally disposed flanges for selectively coupling to the cover.

16. The method of claim 12, wherein the first retainer and the second retainer are coupled to the all by way of at least one fastener respectively.

17. The method of claim 16, wherein the at least one fastener is a self-tapping screw.

18. The method of claim 12, further comprising coupling a top member to the first retainer and the second retainer, wherein the top member cooperates with the cover to provide a substantially flush corner guard.

19. A corner guard comprising:

a retaining, assembly comprising a first wing and a second wing flexibly coupled to one another to define a mounting angle, wherein the retaining assembly is selectively coupleable around a corner of a wall, and wherein the wings include one or more apertures through the planar surfaces of the wings for receiving a fastener;

a pair of flanges integrally formed with a distal edge of the first wing and a distal edge of the second wing respectively;

a cover having a pair of substantially planar elongate segments interconnected by way of a central segment configured to wrap around the corner of the wall, wherein edges of the cover comprise hooked portions configured to sliding receive one of the pair of flanges of the first wing and the second wing to thereby couple the cover to the retaining assembly; and a top member coupled to an upper edge of the wings, wherein the top member comprises a first downwardly extending tab and a second downwardly extending tab to facilitate coupling of the top member to the wings, wherein the first and second tab have holes thereon to receive screws that protrude through the top member and through corresponding holes in the wings, and wherein the top member overhangs the cover to provide a flush appearance.

20. The corner guard of claim 19, wherein the first wing and the second wing are selectively bendable with respect to one another so as to be coupleable to a corner having an angle of approximately 67 degrees to approximately 158 degrees.

21. A corner guard comprising:

a retaining assembly comprising a first wing and a second wing flexibly coupled to one another to define a mounting angle, wherein the retaining assembly is selectively coupleable around a corner of a wall, and wherein the wings include one or more apertures through the planar surfaces of the wings for receiving a fastener;

a hinge formed by an adhesive tape that extends from the first wing to the second wing between the first wing and the second wing;

a pair of flanges integrally formed with a distal edge of the first wing and a distal edge of the second wing respectively;

a cover having a pair of substantially planar elongate segments interconnected by way of a central segment configured to wrap around the corner of the wall, wherein edges of the cover comprise hooked portions configured to sliding receive one of the pair of flanges of the first wing and the second wing to thereby couple the cover to the retaining assembly; and a top member coupled to an upper edge of the wings, wherein the top member comprises a first downwardly extending tab and a second downwardly extending tab to facilitate coupling of the top member to the wings, wherein the first and second tab have holes thereon to receive screws that protrude through the top member and through corresponding holes in the wings, and wherein the top member overhangs the cover to provide a flush appearance.

* * * * *